United States Patent [19]

Tzou

[11] Patent Number: 4,953,375

[45] Date of Patent: Sep. 4, 1990

[54] ELECTRONICALLY SELF-LATCHING CYLINDER LOCK

[76] Inventor: Kae M. Tzou, 3 Fl., No. 181, Sec. 5, Chung Hsiao E. Rd., Taipei, Taiwan

[21] Appl. No.: 480,858

[22] Filed: Feb. 16, 1990

[51] Int. Cl.[5] ..... E05B 17/00

[52] U.S. Cl. ..... 70/441; 70/419; 70/DIG. 49

[58] Field of Search ..... 70/441, 439, 432, 433, 70/434, 435, 419, DIG. 49

[56] References Cited

U.S. PATENT DOCUMENTS

| | | | |
|---|---|---|---|
| 2,623,959 | 12/1952 | Jarrett | 70/441 |
| 4,186,578 | 2/1980 | Sommer | 70/419 |
| 4,205,542 | 6/1980 | Renda | 70/434 |
| 4,328,691 | 5/1982 | Scherbing | 70/363 |

*Primary Examiner*—Robert L. Wolfe

*Attorney, Agent, or Firm*—Morton J. Rosenberg; David I. Klein

[57] ABSTRACT

An electronically self-latching cylinder lock comprising a cylinder into which a plug is eccentrically inserted, a plurality pairs of pin tumblers each of which is disposed in one of a plurality of bores formed inside the cylinder and the plug, and a plurality of switches which are controlled by the pin tumblers. The switches are used to actuate an electronic circuit to send out warnings with a buzzer and to secure the plug at its locked position by a latch means, which is controlled by a solenoid, when an incorrect key is inserted into the key way.

2 Claims, 4 Drawing Sheets

ELECTRONICALLY SELF-LATCHING CYLINDER LOCK

BACKGROUND OF THE INVENTION

The present invention relates generally to cylinder locks and especially to a cylinder lock with self-latching means.

Cylinder locks have wide applications in everyday life. The importance of the cylinder locks is evident. The conventional cylinder locks, however, have a major disadvantage. That is, it can be unlocked by using suitable tools, such as picks.

SUMMARY OF THE INVENTION

It is therefore a feature of the subject invention to provide a cylinder lock which, if not opened by the correct key, can secure the plug from being rotated even though the pin tumblers thereof are all in alignment with the interface between the plug and the cylinder.

It is another feature of the present invention to provide a cylinder lock which sends out warnings when the key way is inserted by incorrect keys or picks.

It is a further feature of the present invention to provide a cylinder lock incorporating with self-latching device which can replace the conventional cylinder locks without modifying the bore where the cylinder lock is inserted.

Other features and advantages of the present invention will be apparent from the following description taken in conjunction with the accompanying drawings, in which like reference numerals designate the same or similar parts throughout the figures thereof.

DETAILED DESCRIPTION OF THE PREFERRED EMBODIMENT

Figure 4:
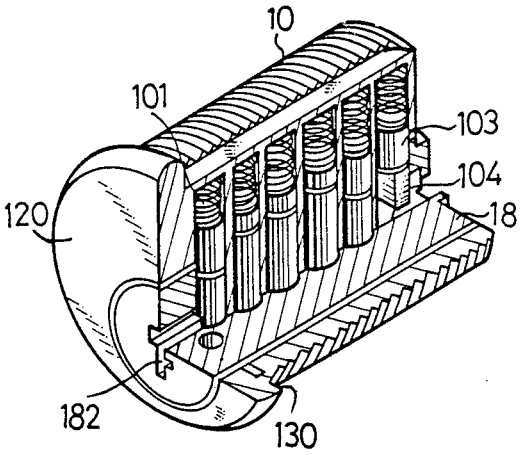
FIG. 4 PRIOR ART
FIGS. 4 and 5 show a conventional cylinder lock with a key inserted in the key way of the cylinder lock shown in FIG. 4.
Figure 5:
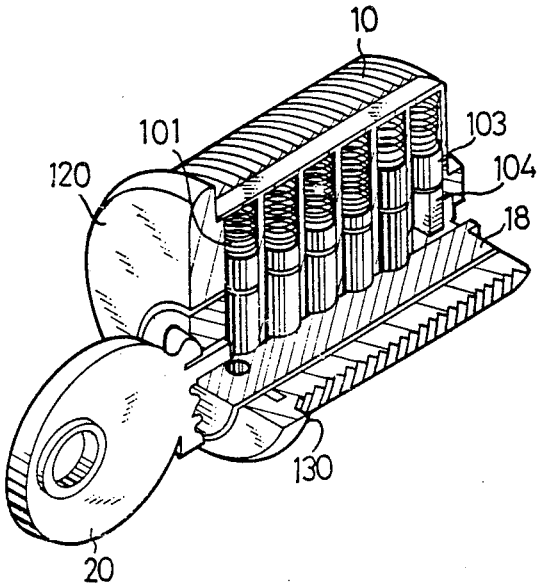
FIG. 5 PRIOR ART

Referring to FIGS. 4 and 5, wherein a conventional cylinder lock is shown, a cylinder lock comprises a cylinder 10 and a lock face 120 which has a diameter larger than that of the cylinder 10 and which is formed on an end of said cylinder 10 so as to form a shoulder 130 between cylinder 10 and the lock face 120. The shoulder 130 abuts the edge of a bore (not shown) in which the cylinder lock is installed. A plug 18 with a key way 182 is eccentrically inserted into the cylinder 10. A plurality of spring-loaded pin tumblers are disposed inside a plurality of bores 101 formed inside the cylinder 10 and extending to the key way 182 to constrain the rotation of the plug 18 so as to secure the plug 18 at the locked position. Each of the pin tumbler is constituted by an upper part 103 and a lower part 104 which contact each other. When a key 20 is inserted into the key way 182, the pin tumblers are moved away from the key way 182. With the contacting surface of the upper part 103 and the lower part 104 in alignment with the interface between the plug 18 and the cylinder 10, the plug 18 is rotatable to the unlocked position.

Figure 1:
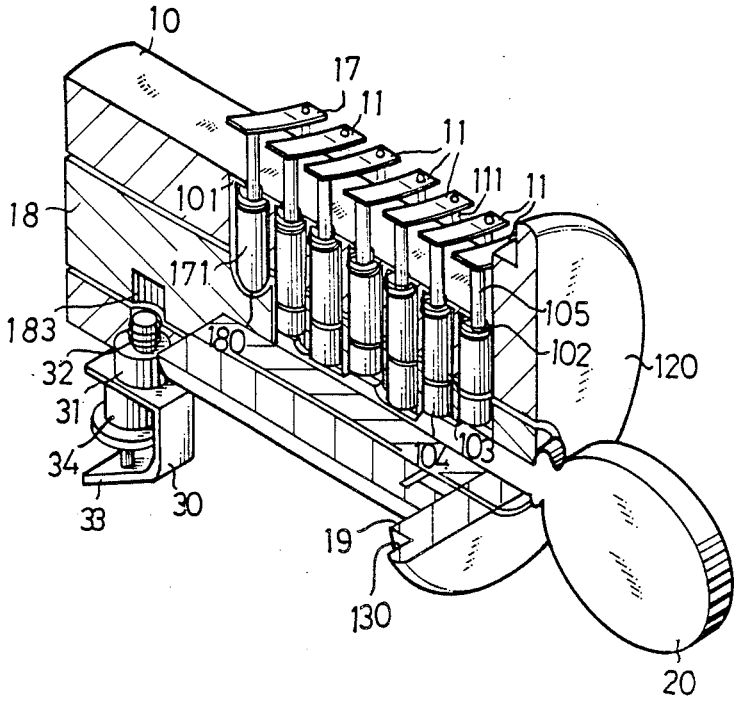
FIG. 1 shows a perspective view of the cylinder lock in accordance with the present invention with part of the cylinder being taken away to show the inside construction.
Figure 2:
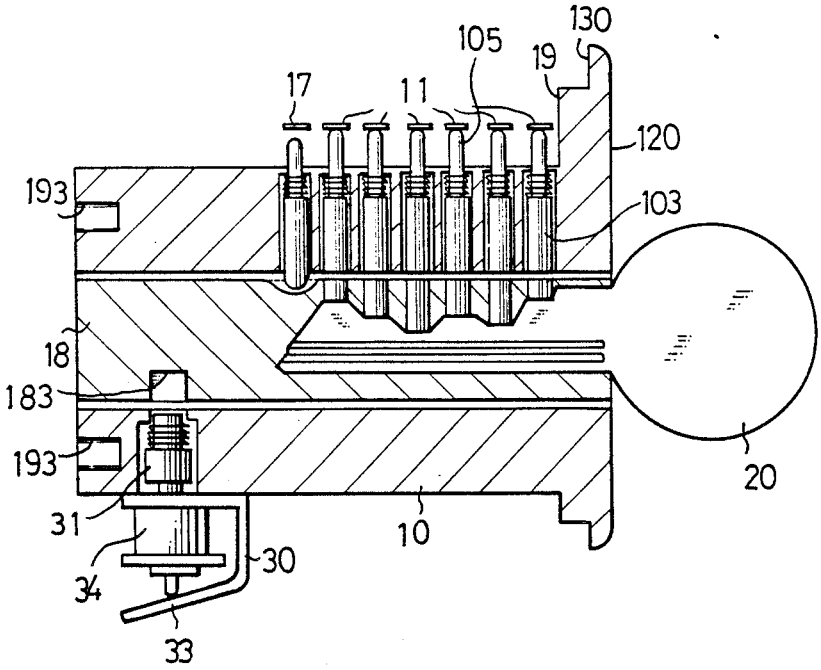
FIG. 2 is the sectional view of the cylinder lock shown in FIG. 1.

Referring now to FIGS. 1 and 2, the cylinder lock in accordance with the present invention comprises a plurality of switches 11 each of which is associated with one of the pin tumblers. Each of the switches 11 includes a spike 105 fixed on the upper part 103 of the associated pin tumbler, running through the helical spring 102, and protruding out of the cylinder 10. Each spike 105 is associated with a piece of strip-like resilient conductor 113 which is fixed on the cylinder 10 via an insulator 111. The resilient conductor 113 is so disposed that when the pin tumbler is moved away from the key way 182, the spike 105 will contact the resilient conductor 113 to form an electrical closed loop.

The cylinder lock in accordance with the present invention is so dimensioned that the largest diameter of the cylinder 10 is less than the inside diameter of a bore (not shown) wherein the cylinder lock is inserted. A shoulder 19 with the same diameter as the bore is further define between the shoulder 130 and the cylinder 10 so that when the cylinder lock is installed, the shoulder 19 abuts the edge of the bore. To securely fixed the cylinder lock inside the bore, a plurality of threaded holes are form on an end of the cylinder 10 which is opposite to the end adjacent to the lock face 120. The cylinder lock therefore can be fixed by means of screws (not shown).

There is another switch 17 corresponding to a control pin 171. The construction of the switch 17 is the same as the other switches 11, but the pin 171, instead of being constituted by two parts as the pin tumblers, is a whole piece and is disposed in a bore formed inside the cylinder 10. The lower end of the pin 171 is disposed in a slot 180 formed on the surface of the plug 18. The slot 180 is so formed that when the plug 18 is rotated, the slot 180 will be inclined and the pin 171 be pushed upwards along the slot 180 and as a result, the spike associated therewith will contact the resilient conductor of the switch 17.

The cylinder lock in accordance with the present invention further comprises a self-latching means 30 which comprises a latch 31 in connection with a solenoid 34 disposed in the cylinder 10 and a hole 183 formed in the plug 18. The latch 31 which is encompassed by a spring 32 is disposed on a movable seat 33 which is made of ferromagnetic material and is so shaped that when the solenoid is energized, the movable seat 33 will be attracted, pushing the latch 31 forwards into the hole 183 so as to secure the plug 18 at the locked position.

Figure 3:
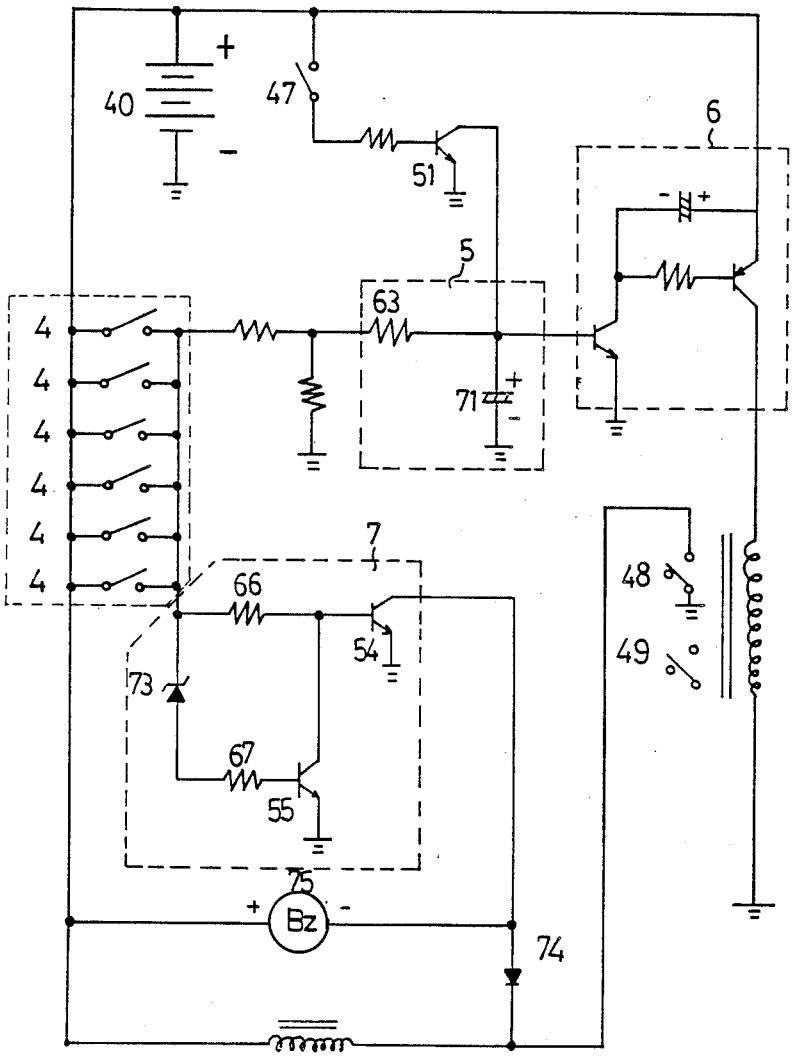
FIG. 3 shows the circuit of the present invention.

Referring now to FIG. 3, the circuit of the present invention comprises a battery set 40, a plurality of switches 4, an integration circuit 5, which is constituted by a resistor 63 and a capacitor 71, and a triggering circuit 6. The common output of the switches 4 is connected to both the integration circuit 5 and a battery testing circuit 7. The output of the integration circuit 5 is connected to the triggering circuit 6 which is in turn connected to a relay. The relay controls a switch 48 to which a buzzer 75 and the solenoid 34 are connected. The output of the integration circuit 5 is connected to the ground via a transistor 51 which is controlled by a switch 47.

The circuit operates as follows: When an incorrect key or a pick is inserted into the key way 182, one or more of the pin tumblers will be moved away from the key way 182 and the associated switch(s) 4 will be closed so that the capacitor 71 will be charged. After a time interval determined by the integration circuit 5, the capacitor 71 will be charged to some extent and the triggering circuit 6 will be actuated. As a result, the switch 48 is closed, the buzzer 75 sounds, and the solenoid 34 energized. With the solenoid 34 energized, the latch 31 moves into the hole 183 and secure the plug 18 at the locked position. If a correct key is inserted into the key way 182, besides the switches 4, the switch 47 is also closed. Under this situation, the capacitor 71 discharges through transistor 51 and the triggering circuit 6 is disabled. As a result, the buzzer 75 does not sound and the latch 31 is not moved into the hole 183. The plug 18 can then be rotated by the key 20 to the unlocked position.

The circuit of the present invention further comprises a battery testing circuit 7 which is constituted by a Zenen diode 73, two resistors 66 and 67, and two transistors 54 and 55. When the voltage of the battery set 40 drops to a lever lower than the Zener voltage of the Zener diode 73, the transistor 54 will become conducted and the buzzer 54 will sound to indicate that the voltage of the battery set 40 has become lower than necessary.

In accordance with the circuit shown in FIG. 2, it can be observed that there is no difference that any combination of the switches 11 are turned on and it is thus possible to connect the resilient conductors 113 together side by side to form a large piece of common conductor which is contactable by all the spikes 105 associated with the pin tumbers, without affecting the intended results of the present invention.

The foregoing is considered illustrative only of the principles of the invention. Further, since numerous modifications and changes will readily occur to those skilled in the art, it is not desired to limit the invention to the construction and operation described above and the invention disclosed herein is intended to cover all such modifications as fall within the scope of the appended claims.

I claim:

1. An electronically self-latching cylinder lock comprising a cylinder into which a plug with a key way is inserted, a plurality of pin tumblers each of which is disposed in one of a plurality of bores formed inside said cylinder and said plug and extending to said key way, a plurality of switches associated with said pin tumblers, a latching means, a warning means, and an electronic circuit which is controlled by said switches to drive said latch means and said warning means, and characterized in that:

each of said switches is constituted by a spike, which is fixed on an associated pin tumbler of said pin tumblers and protrudes out of said cylinder, and a resilient conductor which is fixed to said cylinder via an insulator so that when said spike is caused to move upwards by said associated pin tumbler, said spike will contact said resilient conductor to form a closed electric loop;

said cylinder lock further comprises a control pin which has an associated switch including a spike fixed on said pin and a resilient conductor fixed on said cylinder via an insulator and which is disposed inside a bore formed inside said cylinder with the lower end thereof contacting a slot formed on the surface of said plug so that when said plug is rotated, said slot will be inclined and said pin will be driven to have said spike thereof contact said resilient conductor;

said latching means comprises a latch disposed on a seat which is made of ferromagnetic material and a solenoid which is connected to said electronic circuit so that when said solenoid is energized by said electronic circuit, said seat will be moved and drive said latch into a hole formed on said plug to prevent said plug from being rotated; and said electronic circuit includes a battery set, a plurality of switches each of which is connected to one of said switches associated with said pin tumblers, a further switch which is connected to said switch associated with said control pin, an integration circuit which is used to provide a time delay to the actuation of said latching means and said warning means, a triggering circuit which controls the actuation of said warning means and said latching means via a relay, and a battery testing circuit which sends out warning signals via said warning means when the voltage level of said battery set drops to be lower than a prespecified value, said electronic circuit being so connected that when an incorrect key is inserted into said key way, said triggering circuit will actuate said relay after a time interval controlled by said integration circuit, said relay then turning on said warning means and said solenoid so as to move said latch into said hole to prevent said plug from being rotated, and when a correct key is inserted into said key way, besides said switches associated with said pin tumblers, said switch associated with said control pin is also closed and said triggering circuit, together with said latching means and said warning means, is disabled.

2. An electronically self-latching cylinder lock as claimed in claim 1 wherein said warning means is a buzzer.

* * * * *